US005211544A

United States Patent [19]

Klumpp et al.

[11] Patent Number: 5,211,544

[45] Date of Patent: May 18, 1993

[54] HYDRAULIC PUMP

[75] Inventors: Rolf Klumpp, Kernen; Claus-Peter Höptner, Uhingen; Uwe Matena, Backnang, all of Fed. Rep. of Germany

[73] Assignee: Mercedes-Benz AG, Fed. Rep. of Germany

[21] Appl. No.: 836,510

[22] Filed: Feb. 18, 1992

[30] Foreign Application Priority Data

Feb. 19, 1991 [DE] Fed. Rep. of Germany ..... 4105030

[51] Int. Cl.[5] ..... F04B 49/00

[52] U.S. Cl. ..... 417/286; 417/287; 417/288

[58] Field of Search ..... 417/286, 287, 288

[56] References Cited

U.S. PATENT DOCUMENTS 4,245,964 1/1981 Rannenberg .
4,502,845 3/1985 Chana .
5,087,177 2/1992 Haley et al. ..... 417/288

FOREIGN PATENT DOCUMENTS 2512432 9/1976 Fed. Rep. of Germany .
3142604 1/1981 Fed. Rep. of Germany .
3608469 10/1987 Fed. Rep. of Germany .
3837599 5/1990 Fed. Rep. of Germany .

*Primary Examiner*—Richard A. Bertsch
*Assistant Examiner*—Alfred Basichas
*Attorney, Agent, or Firm*—Evenson, McKeown, Edwards & Lenahan

[57] ABSTRACT

A constructionally simplified hydraulic pump has two pump elements which discharge from a common suction chamber. The flows can be alternatively fed in common to a pressure outlet or separately to two outlets, one of which outlets leads back into the suction chamber. The pressure-side chambers for the separated flows can be connected, via a unidirectional valve, through which, in the open state, the flow of one pump element can be united with that of the second pump element. The different flow guide modes are switched via control valves whose position depends only on the pressure prevailing at the pressure outlet of the hydraulic pump. The control valves to be switched are a common component of a single control slide valve.

4 Claims, 2 Drawing Sheets

HYDRAULIC PUMP

BACKGROUND AND SUMMARY OF THE INVENTION

The present invention relates to a hydraulic pump having a first pump element sucking from a common suction chamber into a first chamber forming the pressure outlet of the hydraulic pump, and a second pump element sucking into a second chamber.

A hydraulic pump of the general type is disclosed in DE-A-3,837,599, but this known pump is too complicated in construction. The present invention has as an object the construction of such a pump type in a structurally simpler fashion and thus the achievement of a more cost-effective production.

The foregoing objective has been achieved with a hydraulic pump in which, with a discharge pressure of the pressure outlet below a first limiting value of a discharge pressure, two pressure chambers are connected to one another via an open unidirectional valve, and the connection between the pressure chambers and the common suction chamber is locked by a shifter; with a discharge pressure at a first limiting value, the delivery valve is closed and the control valve is set in a position in which only the second pressure chamber is connected to the suction chamber; and, with a discharge pressure at a second limiting value corresponding to a position of the control valve, a throttle connection between the first pressure chamber and the second pressure chamber is opened by the actuating piston, and the connection between the second pressure chamber and the suction chamber continues to remain open due to the shifter.

The basic difference in the solution according to the present invention by contrast with the previously known oil pump resides essentially in the fact that, below the first limiting value of a discharge pressure prevailing at the pressure outlet, the flow of the second chamber is discharged directly via the unidirectional valve, i.e. a non-return valve, into the first chamber forming the pressure outlet of the pump. As a result, control valves necessary and control channels connected thereto can be eliminated.

DE-A-3,142,604 discloses an oil pump in which two pump units discharge from a common suction chamber optionally into a common pressure outlet or separate pressure outlets, and have a unidirectional valve connecting the two pressure outlets to one another. This known oil pump arrangement is different from the present invention because the respective unidirectional valves function completely differently. In particular, the unidirectional valve of the present invention ensures that, below a first limiting value of the discharge pressure prevailing at the pressure outlet, the flows of the two pump units are led into a common pressure outlet of the pump, and the unidirectional valve of the known oil pump device is connected and controlled such that it cannot open until it is above a preset discharge pressure at the pressure outlet of the pump, while it is held closed by a control valve in the case of a discharge pressure below this limiting value.

Owing to the different sort of functional designation of that previously known oil pump, in which, by contrast with that according to the present invention, two discharge pumps discharge into a common pressure outlet not in the case of a low discharge pressure at the pump outlet but in the case of a high discharge pressure at the pump outlet, that pump has a control and switching mechanism that is of an entirely different overall sort, as a result of which the structure and the function of the valve controls necessary in the two cases are not comparable to one another.

BRIEF DESCRIPTION OF THE DRAWINGS

These and other features, objects and advantages of the present invention will become more apparent from the following detailed description of a currently preferred embodiment when taken in conjunction with the accompanying drawings wherein.

DETAILED DESCRIPTION OF THE DRAWINGS

Figure 1:
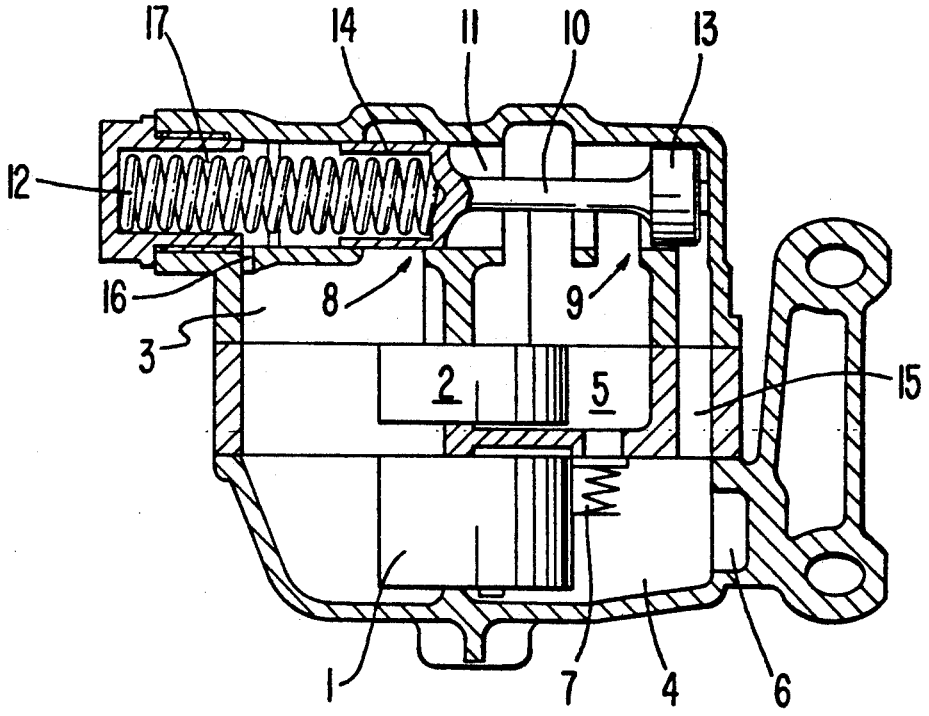
FIG. 1 is a sectional view through a hydraulic pump according to the present invention.

Two circulation impellers 1 and 2 work in a divisible case of a hydraulic pump and are driven in common. The circulation impeller 1 discharges a primary flow and the circulation impeller 2 discharges a secondary flow. The two circulation impellers 1, 2 discharge from a common suction chamber 3. On the pressure side, the circulation impeller 1 discharges into a first chamber 4, and the circulation impeller 2 discharges into a second chamber 5. The first chamber 4 opens directly into the pressure outlet 6 of the hydraulic pump. The two chambers 4, 5 are connected to one another by a unidirectional valve 7 which opens in the direction of the first chamber 4.

The suction chamber 3 can be connected, via a first control valve 8, to the second chamber 5, and beyond this can also further be connected, via a second control valve 9, to the first pressure chamber 4. The second control valve 9 is expediently constructed as a throttle valve. The actuation of the two valves 8, 9 is performed via a control slide valve 10 which is guided in a bore 11 of the hydraulic pump. One end face of the control slide valve 10 is subjected to a force in its longitudinal axis by a spring 12. This end face is also exposed to the pressure of the suction chamber 3. The opposite end face of the control slide valve is exposed to the pressure of the first chamber. The control valves 8, 9 are actuated by the actuating pistons 13, 14 which are components of the control slide valve 10. In this embodiment, the actuating piston 13 is a part of the valve 9, and the actuating piston 14 is a part of the valve 8. In addition, the two actuating pistons 13, 14 also further execute the function of working pistons guided in the bore 11. The actuating piston 13 is connected to the first pressure chamber 4 via a channel 15.

One end face of the actuating piston 14 subjected to the action of a spring adjoins the second chamber 5, and its other end face adjoins a damping chamber 17 which is connected to the suction chamber 3 via a throttle bore 16.

Figure 2:
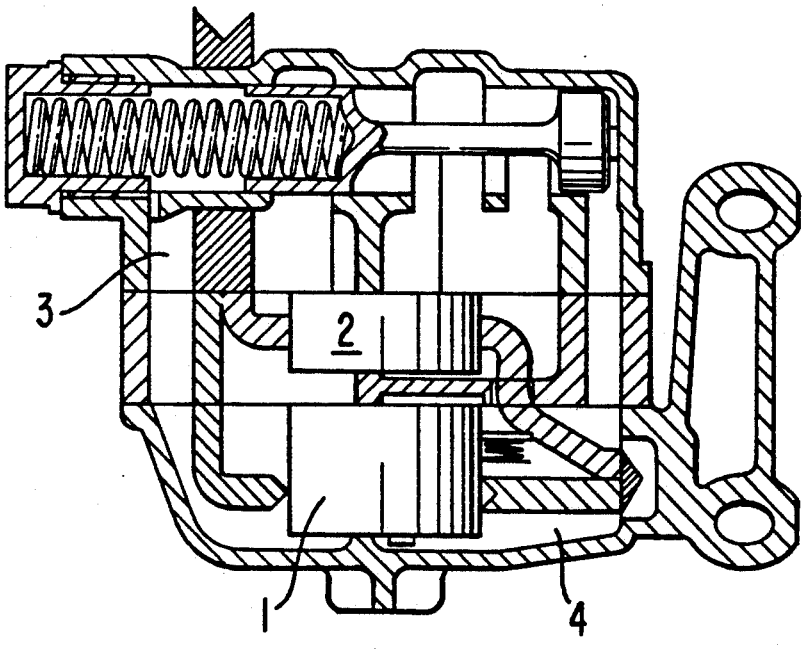
FIGS. 2 through 4 are similar views of various operational functions of the hydraulic pump of FIG. 1.

The function of the hydraulic pump in its various working positions is explained below with reference to FIGS. 2 to 4.

In the working state of the hydraulic pump according to FIG. 2, a discharge pressure below a prescribed first limiting value of the discharge pressure prevails at the pressure outlet of the hydraulic pump. In this situation, the secondary flow leaves the pressure outlet 6 of the discharge pump in common with the primary flow as shown by the two flow paths in the form of broad hatched arrow. In order to feed the secondary flow from the second chamber 5 to the primary flow of the first chamber 4, the unidirectional valve 7 connecting these two chambers is open. The control valves 8, 9 are closed in this working state of the pump. The flows of the two circulation impellers 1, 2 are characterized by different hatching. An additional distinction is further drawn between pressure states on the pressure and suction sides. Since the flows on the pressure side are connected to one another at the same pressure level, the two flows are identically marked.

Figure 3:
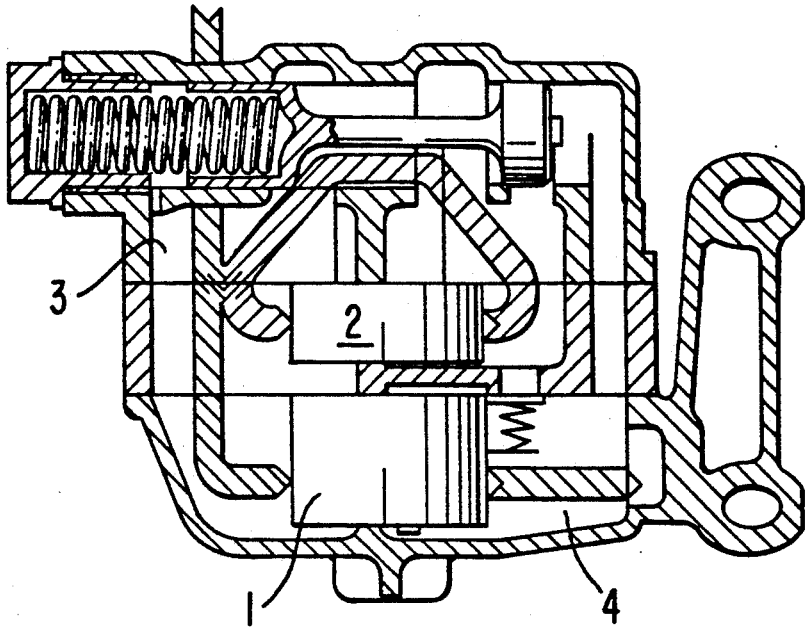

In the working state of the hydraulic pump according to FIG. 3, a pressure greater than the abovementioned first limiting value of the discharge pressure prevails at the pressure outlet 6 of the hydraulic pump. Given this increased discharge pressure (which is still, however, below a second limiting value of the discharge pressure), the control valve 8 opens. The opening of the valve 8, via the actuating piston 14, is effected by the control slide valve 10, on which the discharge pressure prevailing at the pressure outlet 6 is present via the actuating piston 13. Through the open first control valve 8, the circulation impeller 2 discharges the secondary flow produced by the valve back into the suction chamber 3 without counterpressure. The unidirectional valve 7 closes automatically owing to the relief of pressure in the second chamber 5.

Figure 4:
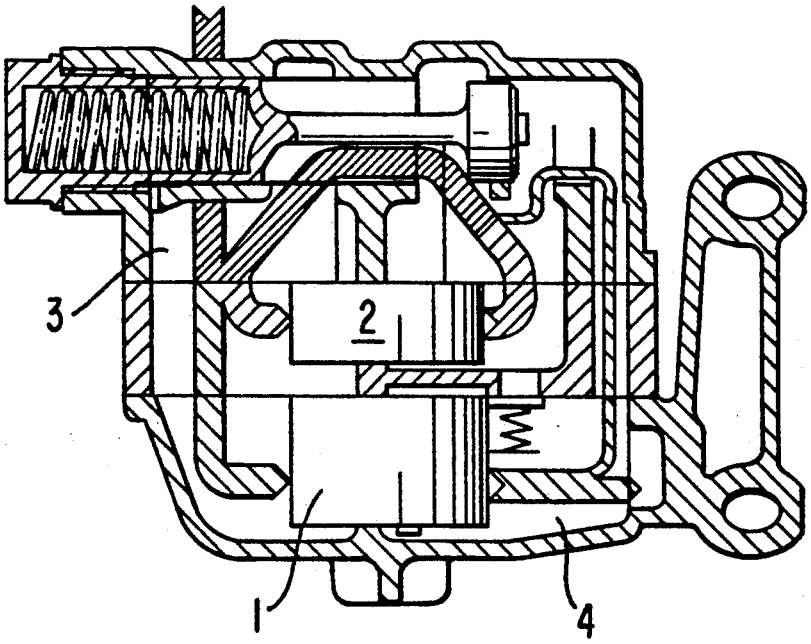

In the working state of the hydraulic pump according to FIG. 4, a discharge pressure greater than the previously defined second limiting value of the discharge pressure prevails at the pressure outlet 6 of the hydraulic pump. In this state, the second control valve 9 is further also open in addition to the first control valve 8. A subflow leading back into the suction chamber, of the primary flow of the first circulation impeller 1 flows through this control valve 9 in a pressure-throttle manner. The opening of the second control valve is effected merely by the pressure of the first chamber 4 which is present on the actuating piston 13 which actuates the valve 9. The control valve 9 is constructed as a throttle valve so as to maintain the necessary pressure difference between the pressure outlet 6 of the hydraulic pump and the suction chamber 3 which are connected to one another via the valve 9.

The hydraulic pump described is preferably intended and suitable for discharging lubricating oil into the lubricating oil circuit of an internal combustion engine. In the working position according to FIG. 2, the hydraulic pump is in such use with the internal combustion engine switched off. In this condition, when the internal combustion engine starts the flows of the two circulation impellers 1, 2 are therefore firstly fed in common to the lubricating oil circuit. This common feeding of the two flows is necessary in the starting and idling phase of the engine given the low speeds prevailing there and the low discharge rates connected therewith. In this case, it should be noted that two circulation impellers 1, 2 are driven on a common shaft at the same speed.

If with increasing engine speed there is an increase in the discharge rate and thus in the pressure at the pressure outlet of the hydraulic pump working as a lubricating oil pump, the hydraulic pump automatically switches into the state according to FIG. 3. In the case of a still further increased speed, it is also further possible for a subflow of the primary flow to be led back to the suction chamber 3 of the pump in a pressure-relieved manner. This is the switching state of the pump shown in FIG. 4.

The object of leading back individual sub flows of the hydraulic pump in a pressure-relieved manner is to avoid performance losses of the pump at high speeds which arise unavoidably owing to unnecessarily high flows working against pressure. The circulation impellers that can be used for the invention can be of any sort, for example elements of a gear pump, trochoidal pump, sickle pump, Eaton pump, screw pump or vane pump.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A gear pump for delivery of lubricating oil into a lubricating oil circuit of an internal-combustion engine, comprising a multi-part pump casing, two gear pairs arranged next to one another in different parts of the casing connected to a common suction chamber, mutually separate pressure chambers arranged in the casing and constituting a first pressure chamber having a common pressure outlet and a first of the gear pairs connected to the first pressure chamber continuously delivering a partial quantity of a delivery fluid into a circuit, and a second pressure chamber associated with a second of the gear pairs and being operatively connected to the first pressure chamber via a pressure channel with a unidirectional valve configured to selectively open and close, and a shifter, guided in a bore of the casing and having a control valve with an actuating piston arranged and configured to be subjected to pressure of the delivery fluid from the first pressure chamber and displaceable against a spring force, and a second actuating piston arranged and configured such that a connection can be controlled between at least one of the first and second pressure chambers and the common suction chamber, and a damper chamber comprised by the bore and shifter connected to the common suction chamber via a throttle bore for controlling movements of the first and second actuating pistons wherein (a) the first actuating piston is constantly acted upon by the pressure of the delivery fluid from the first pressure chamber, (b) in the case of the pressure at the pressure outlet being below a first limiting value, the first and second pressure chambers are connected with one another via the unidirectional valve in an open state, while the connection between the first and second pressure chambers and the suction chambers is blocked by the shifter, (c) when the first limiting value of the delivery pressure is reached, the unidirectional valve is moved to a closed state and the control valve takes up a position in which only the second pressure chamber is connected with the suction chamber, and (d) when a second limiting value of the delivery pressure is reached, the control valve takes up a position in which the first actuating piston opens up a throttle connection between the first pressure chamber and the second pressure chamber, and the connection between the second pressure chamber and the suction chamber remains open.

2. The pump according to claim 1, wherein the first pressure chamber with the first gear pair is arranged in a part of the casing which directly adjoins a part of the casing which accommodates the control valve in the bore.

3. The pump according to claim 1, wherein the first pressure chamber is connected, via a pressure channel, to a control side of the first actuating piston.

4. The pump according to claim 3, wherein the first pressure chamber with the first gear pair is arranged in a part of the casing which directly adjoins a part of the casing which accommodates the control valve in the bore.

* * * * *